US011615727B2

(12) United States Patent
Sliech et al.

(10) Patent No.: US 11,615,727 B2
(45) Date of Patent: Mar. 28, 2023

(54) PREEMPTIVE REFRESH FOR REDUCED DISPLAY JUDDER

(71) Applicant: Apple Inc., Cupertino, CA (US)

(72) Inventors: Kevin W. Sliech, San Francisco, CA (US); Jason N. Gomez, Campbell, CA (US); David A. Hartley, Santa Cruz, CA (US); Chengrui Le, San Jose, CA (US); Paolo Sacchetto, Cupertino, CA (US); Arthur L. Spence, San Jose, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 17/680,103

(22) Filed: Feb. 24, 2022

(65) Prior Publication Data

US 2022/0327977 A1 Oct. 13, 2022

Related U.S. Application Data

(60) Provisional application No. 63/173,924, filed on Apr. 12, 2021.

(51) Int. Cl.
*G09G 3/20* (2006.01)

(52) U.S. Cl.
CPC ..... *G09G 3/20* (2013.01); *G09G 2310/08* (2013.01); *G09G 2320/0252* (2013.01); *G09G 2320/0261* (2013.01); *G09G 2340/0435* (2013.01); *G09G 2370/20* (2013.01)

(58) Field of Classification Search
None
See application file for complete search history.

(56) References Cited

U.S. PATENT DOCUMENTS

| | | | | |
|---|---|---|---|---|
| 6,297,852 | B1 | 10/2001 | Laksono et al. | |
| 10,535,287 | B2 | 1/2020 | Wang et al. | |
| 2011/0255535 | A1* | 10/2011 | Tinsman | H04N 21/4384 370/401 |
| 2012/0081567 | A1* | 4/2012 | Cote | H04N 21/4223 348/222.1 |
| 2013/0188743 | A1* | 7/2013 | Chen | H04N 21/8451 375/240.28 |
| 2013/0293677 | A1* | 11/2013 | Lee | H04N 21/43072 348/43 |
| 2014/0169481 | A1* | 6/2014 | Zhang | H04N 19/172 375/240.24 |

FOREIGN PATENT DOCUMENTS

EP 3629539 A1 4/2020

OTHER PUBLICATIONS

Beeler et al., "Asynchronous Timewarp onOculus Rift," Mar. 25, 2016, https://developer.oculus.com/blog/asynchronous-timewarp-on-oculus-rift/?locale=ko_KR , pp. 1-5.

* cited by examiner

*Primary Examiner* — Dorothy Harris
(74) *Attorney, Agent, or Firm* — Fletcher Yoder, P.C.

(57) ABSTRACT

In an embodiment, an electronic device includes an electronic display. The electronic display provides a programmable latency period in response to receiving a first image frame corresponding to first image frame data. The electronic display also displays the first image frame after the programmable latency period and during display of the first image frame, receives a second image frame corresponding to second image frame data. The electronic display also repeats display of the first image frame in response to receiving the second image frame.

20 Claims, 8 Drawing Sheets

PREEMPTIVE REFRESH FOR REDUCED DISPLAY JUDDER

CROSS REFERENCE TO RELATED APPLICATIONS

This application claims priority from and the benefit of U.S. Provisional Application Ser. No. 63/173,924, entitled "Preemptive Refresh for Reduced Display Judder," filed Apr. 12, 2021, which is hereby incorporated by reference in its entirety for all purposes.

SUMMARY

The present disclosure relates generally to electronic displays and, more particularly, to preemptive refresh in electronic displays.

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

Electronic devices often use one or more electronic displays to present visual representations of information as text, still images, and/or video by displaying one or more image frames. For example, such electronic devices may include computers, mobile phones, portable media devices, tablets, televisions, virtual-reality headsets, and vehicle dashboards, among many others. Electronic displays may include any suitable light-emissive elements, including light-emitting diodes (LEDs), such as organic light-emitting diodes (OLEDs) or micro-light-emitting diodes (μLEDs), and/or may be a liquid-crystal display (LCD). In addition, such devices use less power than comparable display technologies. One technique to further reduce power consumption of an electronic device may involve lowering the electronic display refresh rate when image content is changing slower or remains static.

In fact, some electronic displays may simply display image frames on demand at frame rates specified by processing circuitry of a host device in communication with the electronic display. These displays may continue to display the same image frame until the next image frame is received. Changing conditions on the display, such as changes in temperature or electrical characteristics, however, could cause the image quality of an image frame to degrade over time. As such, many electronic displays specify a frame repeat after the image frame has been displayed for some period of time. The frame repeat causes the image frame to be repeated, sometimes using updated image data that has been compensated to account for the changing conditions on the electronic display. Thus, after an image frame has been displayed on the electronic display for the specified amount of time, the image frame may repeat. The frame repeat may take place internally (e.g., the electronic display may repeat the image frame, which may involve compensating the image data to account for changed conditions) or externally (e.g., the processing circuitry may resend the image frame, which also may potentially involve compensating the image data to account for changed conditions).

Yet frame repeats could result in certain undesirable visual artifacts in some cases. For example, one visual artifact that may be generated is judder, which may be perceived when image frames are unintentionally delayed relative to an expected display time and/or displayed at an uneven cadence, causing jumps in motion of objects. Judder may occur when a subsequent image frame is received at a beginning of a frame repeat or after a frame repeat begins. The subsequent image frame may have to wait for the frame repeat to finish displaying (e.g., based on a minimum frame duration) before beginning display of the subsequent image frame. As such, any additional subsequent image frames may be delayed by an amount of time remaining to display the frame repeat when the subsequent image frame is received causing unintentional latency in the electronic display.

In addition, certain priority content sources (e.g., user interfaces, video conferencing, touchscreens, live gaming) may be more affected by visual artifacts such as judder and latency due to variably driving an electronic display that specifies frame repeats. For example, a user may interact with a touchscreen electronic display with a stylus or writing utensil. Visual artifacts, such as judder and/or unintentional latency, may be perceived and may affect a quality of the user's experience. While fixing the refresh rate to a maximum refresh rate of the electronic display may reduce visual artifacts in some cases, a high-frequency fixed refresh rate consumes large amounts of power, reducing the battery life of an electronic device. Further, judder may occur if frames cannot be generated at such higher rates.

Some undesirable visual artifacts may be addressed by adding an intended amount of latency for each image frame drawn on the electronic display. The intended amount of latency may be set to the minimum frame duration. In some cases, a frame repeat may be preemptively triggered by receiving a subsequent image frame. As such, the subsequent image frame may be drawn on the electronic display after completion of the preemptive frame repeat in time with the intended amount of latency. Additionally, because subsequent image frames are intentionally delayed by a known fixed amount, audio data may be synchronized with corresponding image frames. The addition of an intended amount of latency can thus be traded for reduced judder in some cases. For example, a required frame repeat may interfere with a desired display time of a new image frame. In some instances, judder may be completely removed by providing a sufficient intended amount of latency.

Certain content sources may also be prioritized for displays that can display at multiple refresh rates. For example, content sources, such as user interfaces during interactions, video conferencing, touchscreen interactions, live gaming, fixed rate media, and so forth, may be tracked by a variable refresh rate display to ensure timing accuracy. However, when multiple content sources trigger content updates for image frames, displays may lose precise tracking and timing accuracy, resulting in undesirable visual artifacts, such as judder. Undesirable visual artifacts may be addressed by determining a priority content source and associated framerate. In addition, the variable refresh rate displays may partition a priority frame display period based on a maximum refresh rate of the electronic display. For example, the priority content source may have a 25 Hz framerate and may be displayed on a 100 Hz maximum refresh rate electronic display. The variable refresh rate display may statically partition each priority content image frame time period such that the image frame time period is subdivided into a number of partition periods. In addition, each partition period may be greater than or equal to a minimum frame duration for the maximum refresh rate. The variable refresh rate display may trigger subsequent image frames based on content updates only on boundaries of the partition periods. Additionally or alternatively, the variable refresh rate display may provide dynamic partitioning techniques, such as defining an image frame delay period based on the minimum frame duration. For example, the image frame delay period may be a minimum frame duration before a subsequent priority content image frame is drawn on the electronic display. As such, the variable refresh rate display may intentionally delay the content update until the subsequent priority content image frame is triggered to be displayed on the electronic display.

Accordingly, techniques described herein may improve perceived image quality by reducing the likelihood of visual artifacts, such as judder and unintentional latency. For example, as will be described in more detail below, some embodiments describe adding a fixed amount of latency to each displayed image frame. Additionally, some embodiments determine priority content sources and apply static and/or dynamic partitioning techniques on priority content image frames. With the foregoing in mind, there are many suitable electronic devices that may benefit from the embodiments for reducing display judder described herein.

Various refinements of the features noted above may exist in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION OF SPECIFIC EMBODIMENTS

Figure 1:
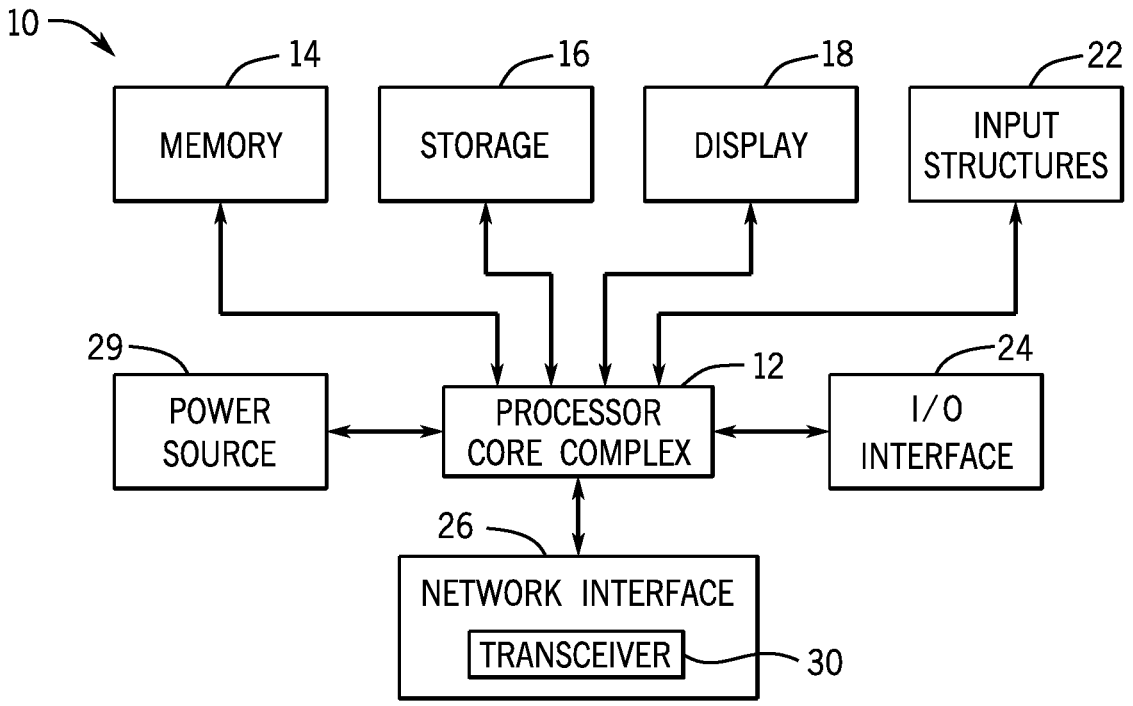
FIG. 1 is a block diagram of an electronic device with an electronic display, according to an embodiment of the present disclosure.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

The disclosed embodiments may apply to a variety of electronic devices. In particular, any electronic device that includes an electronic display, such as mobile devices, tablets, laptops, personal computers, televisions, and wearable devices. As mentioned above, an electronic display may enable a user to perceive a visual representation of information by successively displaying image frames. As used herein, a refresh rate refers to the number of times that an electronic display updates its hardware buffers or writes an image frame to the screen regardless of whether the image frame has changed. In other words, the refresh rate includes both new frames and repeated drawing of identical frames, while a framerate measures how often a content source can feed an entire frame of new data to a display. For example, some electronic displays may have a framerate of 24 Hz such that the electronic display advances from one frame to the next frame 24 times each second. Accordingly, a refresh rate may be equal to or greater than a framerate for the images being displayed.

Each refresh of an electronic display consumes power. As such, a higher refresh rate consumes more power than a lower refresh rate. Some electronic displays may be able to refresh the display panel at variable rates. For example, the electronic displays may be able to refresh the display panel at 240 Hz, 60 Hz, 1 Hz, and so forth. When fewer panel refreshes are needed, the electronic display may operate at a lower refresh rate depending on the framerate at which new image frames are received by the electronic display from processing circuitry of a host. Such a reduction in refresh rate may result in certain display circuitry efficiencies, conserving power.

In fact, some electronic displays may simply display image frames on demand at frame rates specified by processing circuitry of a host device in communication with the electronic display. These displays may continue to display the same image frame until the next image frame is received. Changing conditions on the display, such as changes in temperature or electrical characteristics, however, could cause the image quality of an image frame to degrade over time. As such, many electronic displays specify a frame repeat of at least a minimum refresh rate after the image frame has been displayed for some period of time. The frame repeat causes the image frame to be repeated, sometimes using updated image data that has been compensated to account for the changing conditions on the electronic display. Thus, after an image frame has been displayed on the electronic display for the specified amount of time, the image frame may repeat. The frame repeat may take place internally (e.g., the electronic display may repeat the image frame, which may involve compensating the image data to account for changed conditions) or externally (e.g., the processing circuitry may resend the image frame, which also may potentially compensating the image data to account for changed conditions).

Some undesirable visual artifacts due to frame repeats may be addressed by adding an intended amount of latency for each image frame drawn on the electronic display. The intended amount of latency may be set to the minimum frame duration. In some cases, a frame repeat may be preemptively triggered by receiving a subsequent image frame. As such, the subsequent image frame may be drawn on the electronic display after completion of the preemptive frame repeat in time with the intended amount of latency. Additionally, because subsequent image frames are intentionally delayed by a known fixed amount, audio data may be synchronized with corresponding image frames.

Certain content sources may also be prioritized for displays that can display at multiple refresh rates. For example, content sources, such as user interfaces during interactions, video conferencing, touchscreen interactions, live gaming, fixed rate media, and so forth, may be tracked by a variable refresh rate display to ensure timing accuracy. However, when multiple content sources trigger content updates for image frames, displays may lose precise tracking and timing accuracy, resulting in undesirable visual artifacts, such as judder. Undesirable visual artifacts may be addressed by determining a priority content source and associated framerate. In addition, the variable refresh rate displays may partition a priority frame display period based on a maximum refresh rate of the electronic display. For example, the priority content source may have a 25 Hz framerate and may be displayed on a 100 Hz maximum refresh rate electronic display. The variable refresh rate display may statically partition each priority content image frame time period such that the image frame time period is subdivided into a number of partition periods. In addition, each partition period may be greater than or equal to a minimum frame duration for the maximum refresh rate. The variable refresh rate display may trigger subsequent image frames based on content updates only on boundaries of the partition periods. Additionally or alternatively, the variable refresh rate display may provide dynamic partitioning techniques, such as defining an image frame delay period based on the minimum frame duration. For example, the image frame delay period may be a minimum frame duration before a subsequent priority content image frame is drawn on the electronic display. As such, the variable refresh rate display may intentionally delay the content update until the subsequent priority content image frame is triggered to be displayed on the electronic display.

Accordingly, techniques described herein may improve perceived image quality by reducing the likelihood of visual artifacts, such as judder and unintentional latency. For example, as will be described in more detail below, some embodiments describe adding a fixed amount of latency to each displayed image frame. Additionally, some embodiments determine priority content sources and apply static and/or dynamic partitioning techniques on priority content image frames. With the foregoing in mind, there are many suitable electronic devices that may benefit from the embodiments for reducing display judder described herein.

Turning first to FIG. 1, an electronic device 10 according to an embodiment of the present disclosure may include, among other things, one or more processor(s) 12, memory 14, nonvolatile storage 16, a display 18, input structures 22, an input/output (I/O) interface 24, a network interface 26, a power source 29, and a transceiver 30. The various functional blocks shown in FIG. 1 may include hardware elements (including circuitry), software elements (including computer code stored on a computer-readable medium) or a combination of both hardware and software elements. It should be noted that FIG. 1 is merely one example of a particular implementation and is intended to illustrate the types of components that may be present in electronic device 10.

Figure 2:
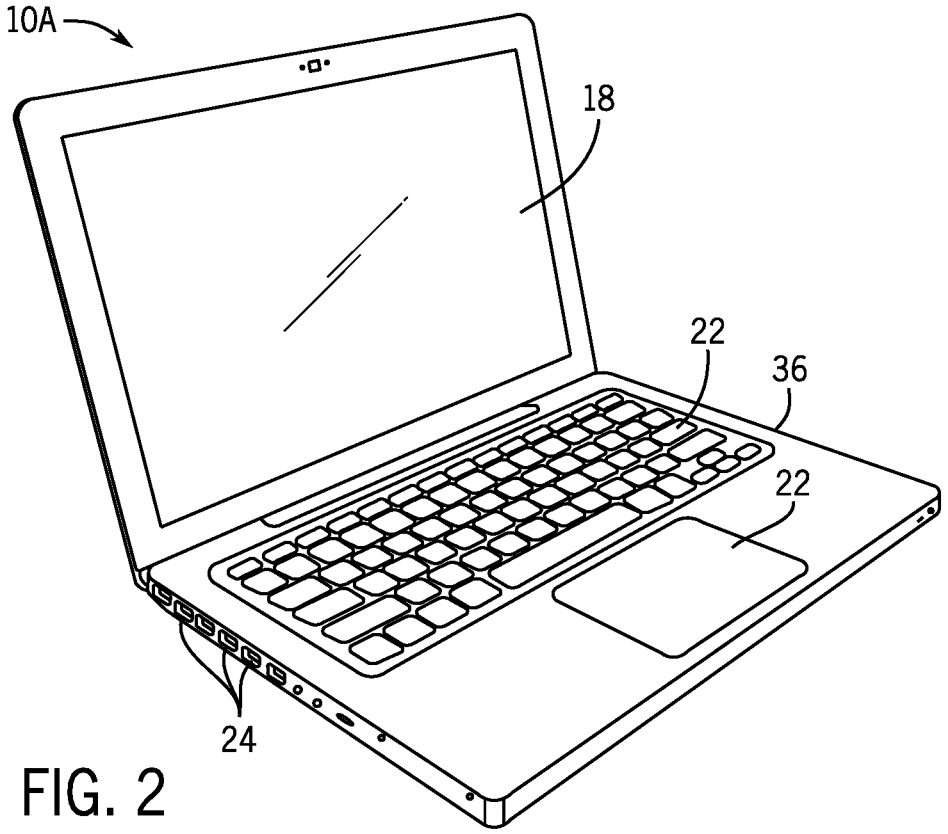
FIG. 2 is a perspective view of a notebook computer representing an embodiment of the electronic device of FIG. 1.
Figure 4:
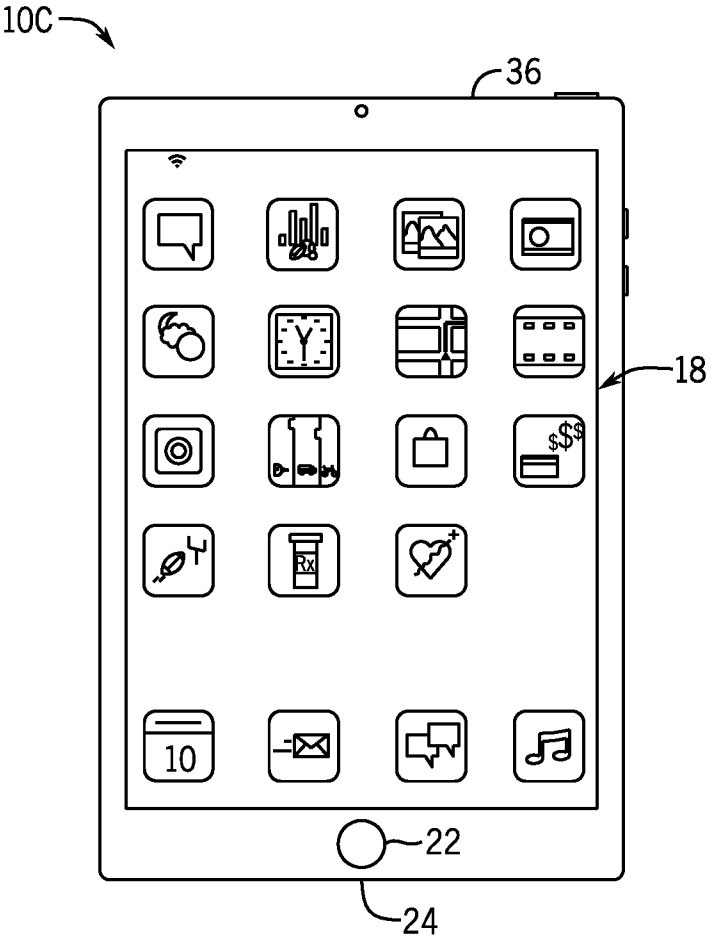
FIG. 4 is a front view of another handheld device representing another embodiment of the electronic device of FIG. 1.
Figure 3:
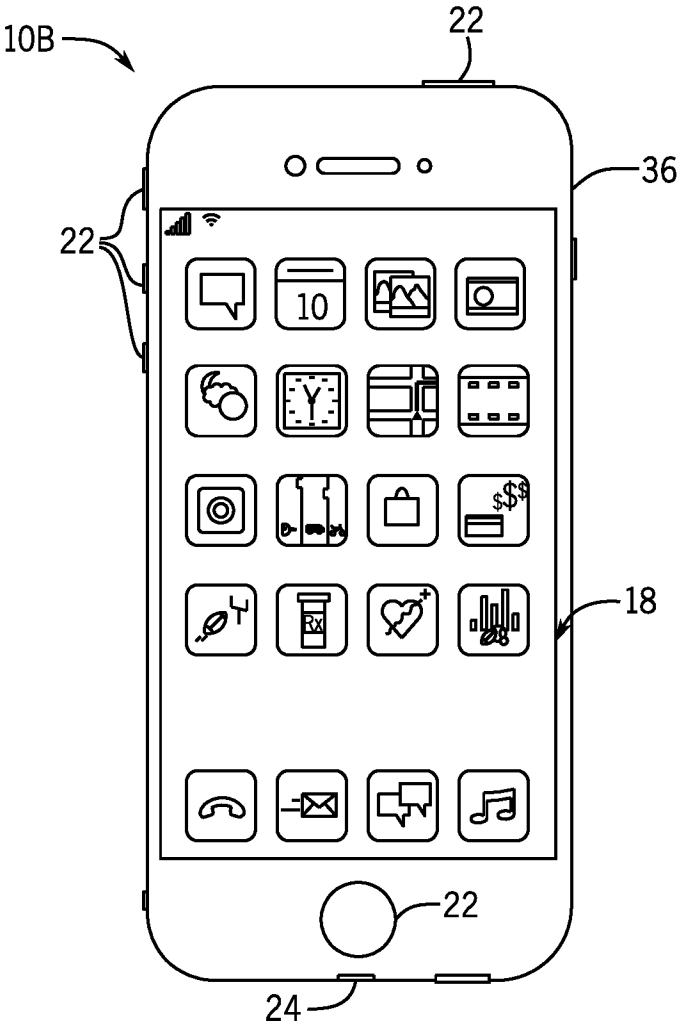
FIG. 3 is a front view of a handheld device representing another embodiment of the electronic device of FIG. 1.
Figure 5:
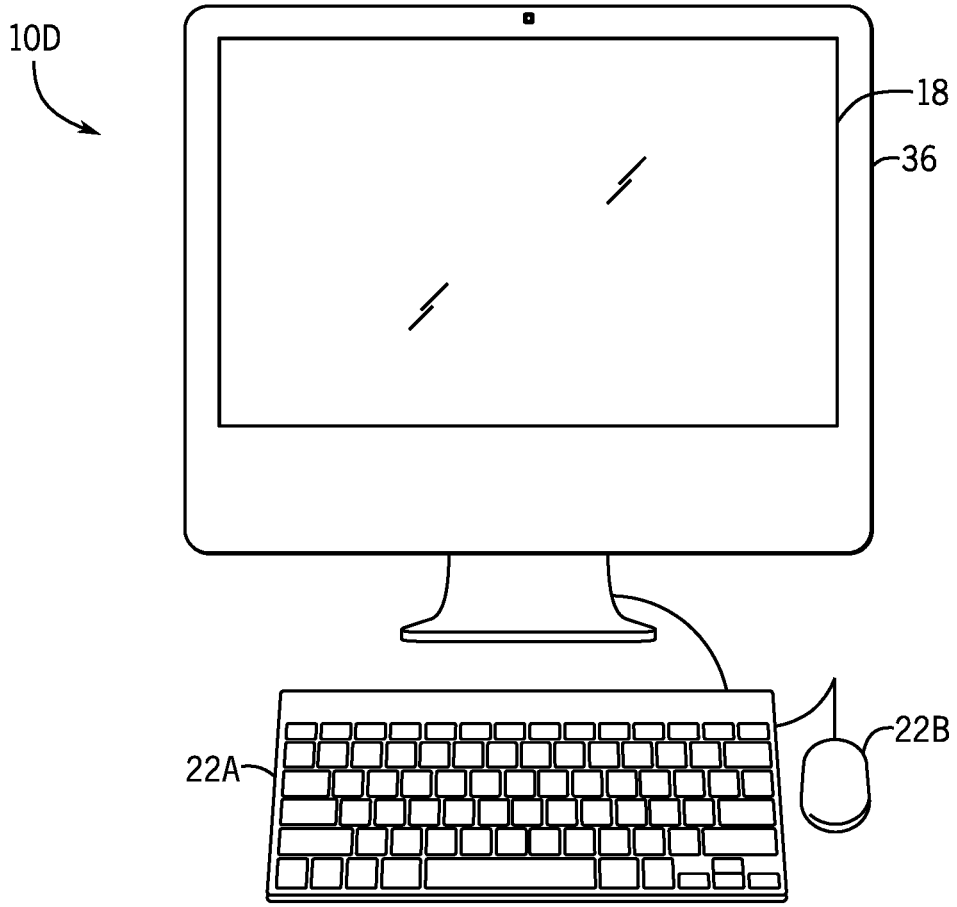
FIG. 5 is a front view of a desktop computer representing another embodiment of the electronic device of FIG. 1.
Figure 6:
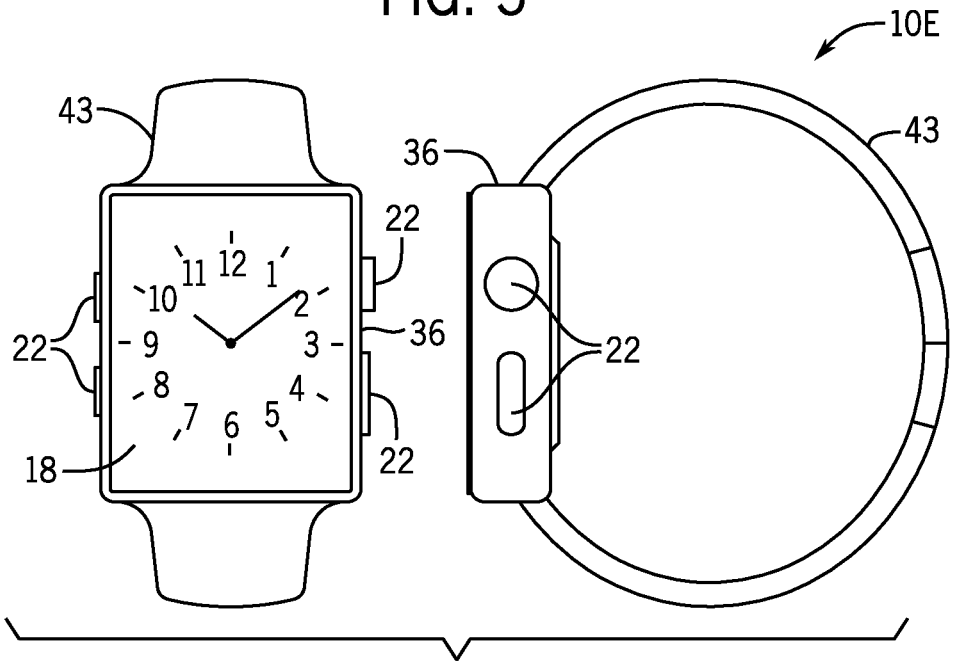
FIG. 6 is a front view and side view of a wearable electronic device representing another embodiment of the electronic device of FIG. 1.

By way of example, the electronic device 10 may represent a block diagram of the notebook computer depicted in FIG. 2, the handheld device depicted in FIG. 3, the handheld device depicted in FIG. 4, the desktop computer depicted in FIG. 5, the wearable electronic device depicted in FIG. 6, or similar devices. It should be noted that the processor(s) 12 and other related items in FIG. 1 may be embodied wholly or in part as software, software, hardware, or any combination thereof. Furthermore, the processor(s) 12 and other related items in FIG. 1 may be a single contained processing module or may be incorporated wholly or partially within any of the other elements within the electronic device 10.

In the electronic device 10 of FIG. 1, the processor(s) 12 may be operably coupled with a memory 14 and a nonvolatile storage 16 to perform various algorithms. Such programs or instructions executed by the processor(s) 12 may be stored in any suitable article of manufacture that includes one or more tangible, computer-readable media. The tangible, computer-readable media may include the memory 14 and/or the nonvolatile storage 16, individually or collectively, to store the instructions or routines. The memory 14 and the nonvolatile storage 16 may include any suitable articles of manufacture for storing data and executable instructions, such as random-access memory, read-only memory, rewritable flash memory, hard drives, and optical discs. In addition, programs (e.g., an operating system) encoded on such a computer program product may also include instructions that may be executed by the processor(s) 12 to enable the electronic device 10 to provide various functionalities.

In certain embodiments, the display 18 may be a liquid crystal display (LCD), which may allow users to view images generated on the electronic device 10. In some embodiments, the display 18 may include a touch screen, which may allow users to interact with a user interface of the electronic device 10. Furthermore, it should be appreciated that, in some embodiments, the display 18 may include one or more organic light emitting diode (OLED) displays, one or more micro light emitting diode (μLED) displays, or some combination of LCD panels, OLED panels, and/or μLED panels.

The input structures 22 of the electronic device 10 may enable a user to interact with the electronic device 10 (e.g., pressing a button to increase or decrease a volume level).

The I/O interface 24 may enable electronic device 10 to interface with various other electronic devices, as may the network interface 26. The network interface 26 may include, for example, one or more interfaces for a personal area network (PAN), such as a Bluetooth network, for a local area network (LAN) or wireless local area network (WLAN), such as an 802.11x Wi-Fi network, and/or for a wide area network (WAN), such as a 3rd generation (3G) cellular network, universal mobile telecommunication system (UMTS), 4th generation (4G) cellular network, long term evolution (LTE) cellular network, long term evolution license assisted access (LTE-LAA) cellular network, 5th generation (5G) cellular network, and/or 5G New Radio (5G NR) cellular network. In particular, the network interface 26 may include, for example, one or more interfaces for using a Release-15 cellular communication standard of the 5G specifications that include the millimeter wave (mmWave) frequency range (e.g., 24.25-300 GHz). The transceiver 30 of the electronic device 10, which includes a transmitter and a receiver, may allow communication over the aforementioned networks (e.g., 5G, Wi-Fi, LTE-LAA, and so forth).

The network interface 26 may also include one or more interfaces, for example, broadband fixed wireless access networks (WiMAX), mobile broadband Wireless networks (mobile WiMAX), asynchronous digital subscriber lines (e.g., ADSL, VDSL), digital video broadcasting-terrestrial (DVB-T) and its extension DVB Handheld (DVB-H), ultra-Wideband (UWB), alternating current (AC) power lines, and so forth. As further illustrated, the electronic device 10 may include a power source 29. The power source 29 may include any suitable source of power, such as a rechargeable lithium polymer (Li-poly) battery and/or an alternating current (AC) power converter.

In certain embodiments, the electronic device 10 may take the form of a computer, a portable electronic device, a wearable electronic device, or other type of electronic device. Such computers may include computers that are generally portable (such as laptop, notebook, and tablet computers) as well as computers that are generally used in one place (such as conventional desktop computers, workstations, and/or servers). In certain embodiments, the electronic device 10 in the form of a computer may be a model of a MacBook®, MacBook® Pro, MacBook Air®, iMac®, Mac® mini, or Mac Pro® available from Apple Inc. By way of example, the electronic device 10, taking the form of a notebook computer 10A, is illustrated in FIG. 2 in accordance with one embodiment of the present disclosure. The depicted computer 10A may include a housing or enclosure 36, a display 18, input structures 22, and ports of an I/O interface 24. In one embodiment, the input structures 22 (such as a keyboard and/or touchpad) may be used to interact with the computer 10A, such as to start, control, or operate a graphical user interface (GUI) or applications running on computer 10A. For example, a keyboard and/or touchpad may allow a user to navigate a user interface or application interface displayed on display 18.

FIG. 3 depicts a front view of a handheld device 10B, which represents one embodiment of the electronic device 10. The handheld device 10B may represent, for example, a portable phone, a media player, a personal data organizer, a handheld game platform, or any combination of such devices. By way of example, the handheld device 10B may be a model of an iPod® or iPhone® available from Apple Inc. of Cupertino, Calif. The handheld device 10B may include an enclosure 36 to protect interior components from physical damage and to shield them from electromagnetic interference. The enclosure 36 may surround the display 18. The I/O interfaces 24 may open through the enclosure 36 and may include, for example, an I/O port for a hardwired connection for charging and/or content manipulation using a standard connector and protocol, such as the Lightning connector provided by Apple Inc., a universal serial bus (USB), or other similar connector and protocol.

User input structures 22, in combination with the display 18, may allow a user to control the handheld device 10B. For example, the input structures 22 may activate or deactivate the handheld device 10B, navigate user interface to a home screen, a user-configurable application screen, and/or activate a voice-recognition feature of the handheld device 10B. Other input structures 22 may provide volume control, or may toggle between vibrate and ring modes. The input structures 22 may also include a microphone that may obtain a user's voice for various voice-related features, and a speaker that may enable audio playback and/or certain phone capabilities. The input structures 22 may also include a headphone input that may provide a connection to external speakers and/or headphones.

FIG. 4 depicts a front view of another handheld device 10C, which represents another embodiment of the electronic device 10. The handheld device 10C may represent, for example, a tablet computer, or one of various portable computing devices. By way of example, the handheld device 10C may be a tablet-sized embodiment of the electronic device 10, which may be, for example, a model of an iPad® available from Apple Inc. of Cupertino, Calif.

Turning to FIG. 5, a computer 10D may represent another embodiment of the electronic device 10 of FIG. 1. The computer 10D may be any computer, such as a desktop computer, a server, or a notebook computer, but may also be a standalone media player or video gaming machine. By way of example, the computer 10D may be an iMac®, a MacBook®, or other similar device by Apple Inc. It should be noted that the computer 10D may also represent a personal computer (PC) by another manufacturer. A similar enclosure 36 may be provided to protect and enclose internal components of the computer 10D such as the display 18. In certain embodiments, a user of the computer 10D may interact with the computer 10D using various peripheral input structures 22, such as the keyboard 22A or mouse 22B, which may connect to the computer 10D.

Similarly, FIG. 6 depicts a wearable electronic device 10E representing another embodiment of the electronic device 10 of FIG. 1 that may be configured to operate using the techniques described herein. By way of example, the wearable electronic device 10E, which may include a wristband 43, may be an Apple Watch® by Apple Inc. However, in other embodiments, the wearable electronic device 10E may include any wearable electronic device such as, for example, a wearable exercise monitoring device (e.g., pedometer, accelerometer, heart rate monitor), or other device by another manufacturer. The display 18 of the wearable electronic device 10E may include a touch screen display 18 (e.g., LCD, OLED display, active-matrix organic light emitting diode (AMOLED) display, and so forth), as well as input structures 22, which may allow users to interact with a user interface of the wearable electronic device 10E.

Figure 7:
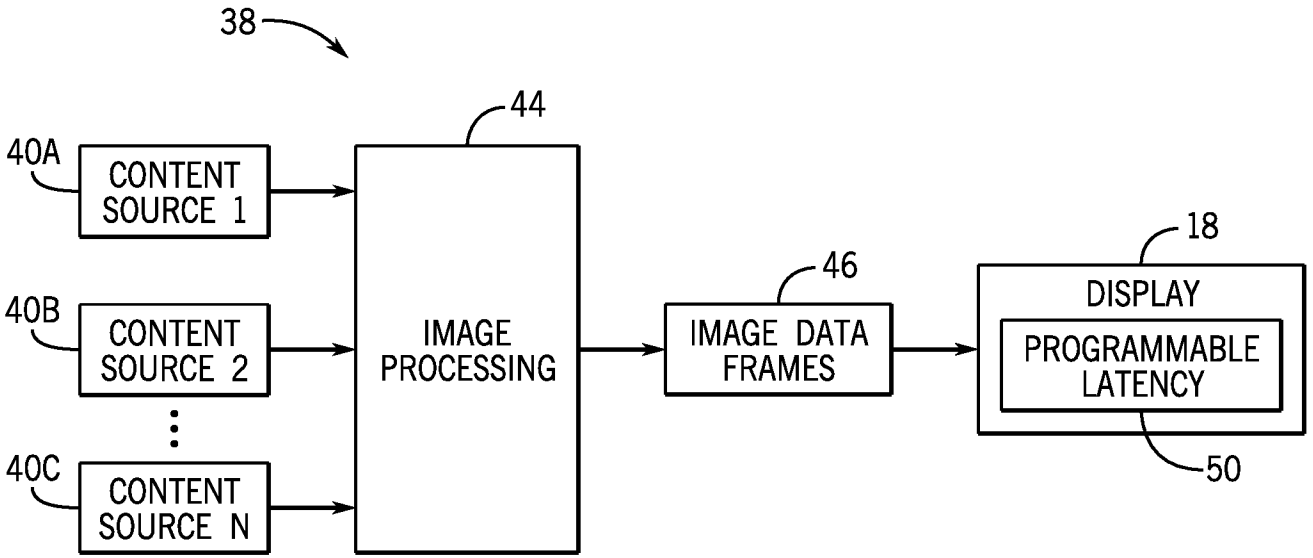
FIG. 7 is a block diagram of an image processing system, in accordance with an embodiment of the present disclosure.

FIG. 7 depicts an image processing system 38 for the electronic device 10. The image processing system 38 may receive image content from any number of content sources (e.g., content sources 40A, 40B, 40C) and may generate image data frames 46. The image processing system 38 may include any number of content sources (e.g., content sources 40A, 40B, 40C), image processing circuitry 44 (e.g., a graphics processing unit and/or display pipeline), and the electronic display 18. The content sources 40A, 40B, 40C may generate and provide image content data to the image processing circuitry 44. Each content source, such as content sources 40A, 40B, 40C, may be an application, an internet browser, a user interface, video or still images stored in memory, or the like. The image processing circuitry 44 may process and analyze the image content data to generate image data frames 46. The image processing circuitry 44 may instruct the electronic display 18 to display image frames based on the image data frames 46. Additionally, the image data frames 46 may include image frames (and, in some cases, a desired refresh rate with which to display the image frames). In certain embodiments, the image processing circuitry 44 may include a frame buffer for storing images that are intended for output to the display 18. The display 18 may include programmable latency 50. For example, the processing circuitry 44 may specify the amount of programmable latency 50 by which the electronic display 18 is to operate. As discussed below, this may allow the electronic display 18 to operate in a low-latency mode (e.g., with little to no programmable latency 50) or a low-judder mode (e.g., with enough programmable latency 50 to avoid waiting to display a new image frame due to a frame repeat).

Figure 8:
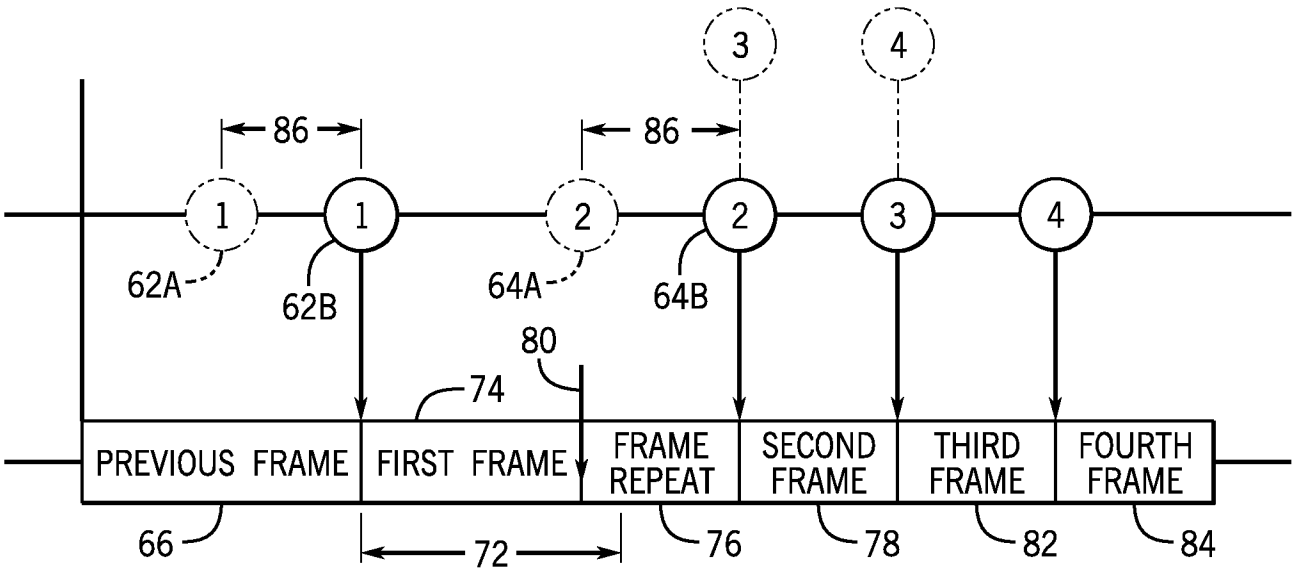
FIG. 8 is a timing diagram describing preemptive display of a repeat image frame, in accordance with an embodiment of the present disclosure.

FIG. 8 is a timing diagram 60 describing preemptive display of a frame repeat 76 on an electronic display, such as electronic display 18, in accordance with an embodiment of the present disclosure. At time, 62A, a previous image frame 66 may be displayed on the electronic display 18 when first image frame data is generated and/or received. For example, image processing circuitry 44 may instruct the electronic display 18 to display a first image frame 74 based on the first image frame data. The first image frame data may include a latency period 86. The latency period 86 may be based on a minimum frame duration (e.g., a display duration threshold) for the electronic display 18. In certain embodiments, the latency period 86 may be less than or equal to the minimum frame duration. Alternatively, the latency period 86 may be greater than or equal to the minimum frame duration. The image processing circuitry 44 may trigger (at time 62B) the first image frame 74 to be displayed on the electronic display 18 after the latency period 86 expires.

The electronic display 18 may also include a frame repeat threshold duration 72 based on the refresh rate of the electronic display 18. If a time duration that any image frame is to remain on the electronic display 18 exceeds the frame repeat threshold duration 72, the frame may repeat. The electronic display 18 may repeat the same content of the first frame 74 in a frame repeat 76 at time 80 (e.g., the electronic display 18 or the image processing circuitry 44 may update the image data of the first frame 74 to account for new conditions on the electronic display 18).

In some embodiments, the image processing circuitry 44 (at time 64A) may instruct the electronic display 18 to display a second image frame 78 based on second image frame data. The image processing circuitry 44 may generate the second image frame data and may instruct the display 18 to display the second image frame 78 before a display duration of the first image frame 74 meets or exceeds the frame repeat threshold duration 72. Accordingly, the image processing circuitry 44 or the electronic display 18 may preemptively trigger the frame repeat 76 in response to receiving and/or generating the content for the second image frame 78 data. In some cases, the second image frame 78 data may indicate the latency period 86 and the image processing circuitry 44 may thus effectively instruct (at time 64B) the electronic display 18 to display the second image frame 78 after the expiration of the latency period 86 (e.g., after a display period for the frame repeat 76). This process may continue as new image frames, such as third image frame 82 and fourth image frame 84, are received and displayed. Alternatively, the image processing circuitry 44 may instruct the electronic display 18 to adjust the latency period 86 and/or to begin a low-judder mode. For example, the electronic display 18 may display each image frame (e.g., first image frame 74, second image frame 78, and so forth) after the expiration of the latency period 86 when operating in the low-judder mode. In certain embodiments, the electronic display 18 may adjust the latency period 86 based on image frame data. For example, the electronic display 18 may receive image frame data and determine a framerate associated with the image frame data. The electronic display 18 may continue to operate in the low-judder mode until a subsequent instruction from the image processing circuitry 44 to end the low-judder mode and/or to begin a low-latency mode. Additionally, the image processing circuitry 44 may instruct the electronic display 18 to adjust (e.g., increase, decrease) the latency period 86 when operating in the low-judder mode.

Figure 9:
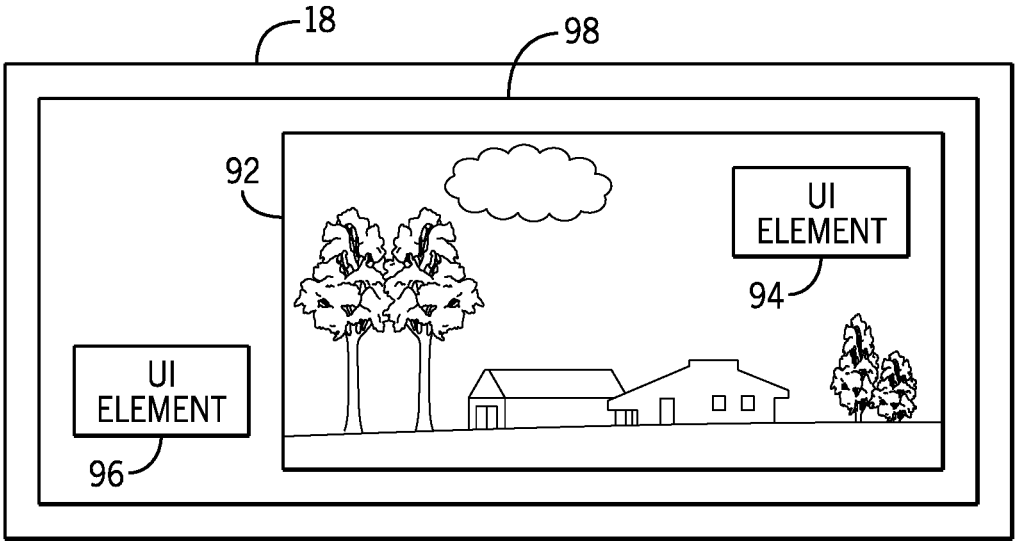
FIG. 9 is a diagram of the electronic display of FIG. 1 having multiple content types, in accordance with an embodiment of the present disclosure.

At times, an electronic display may display image data having content deriving from different content sources of varying importance to the viewer (e.g., from content sources 40A, 40B, or 40C of FIG. 7). In FIG. 9, a movie from a first content source is being shown on the electronic display 18 in a first area 92, while user interface (UI) elements 94 and 96 from a second content source are disposed over the movie and in a second area 98 surrounding the first area 92. This type of arrangement may arise when using video editing software. Under these circumstances, judder in the content of the movie may be noticeable and undesirable, while judder in the UI elements 94 and 96 may be imperceptible or at least less disruptive to the user experience Thus, the image processing circuitry 44 and/or the electronic display 18 may prioritize the display of image frames with updates from a particular content source. Indeed, in this particular example, movie content from the first content source may have a framerate of 25 frames per second and UI content from the second content source may have a framerate of 100 frames per second. This means that the UI elements 94 and 96 could change between the times when the movie content will next change. Problems could arise if the changes in the UI elements 94 and 96 cause a new image frame to be generated just before the time when the movie content would change. Displaying the new image frame (with updated UI content and the old movie content) takes at least a minimum refresh rate amount of time. Thus, if the new image frame starts being displayed shortly before the movie content should change and completes afterward, the new movie content may be late, producing a judder artifact. To prevent this from happening, the image processing circuitry 44 may determine the first content source to be a priority content source. For example, the image processing circuitry 44 may determine the first content source has a higher priority than any number of other content sources. Thereafter, image frames containing changes deriving from other content sources may be made to display at times that would not interfere with the specified display timing of the prioritized content source to reduce undesirable visual artifacts.

Figure 10:
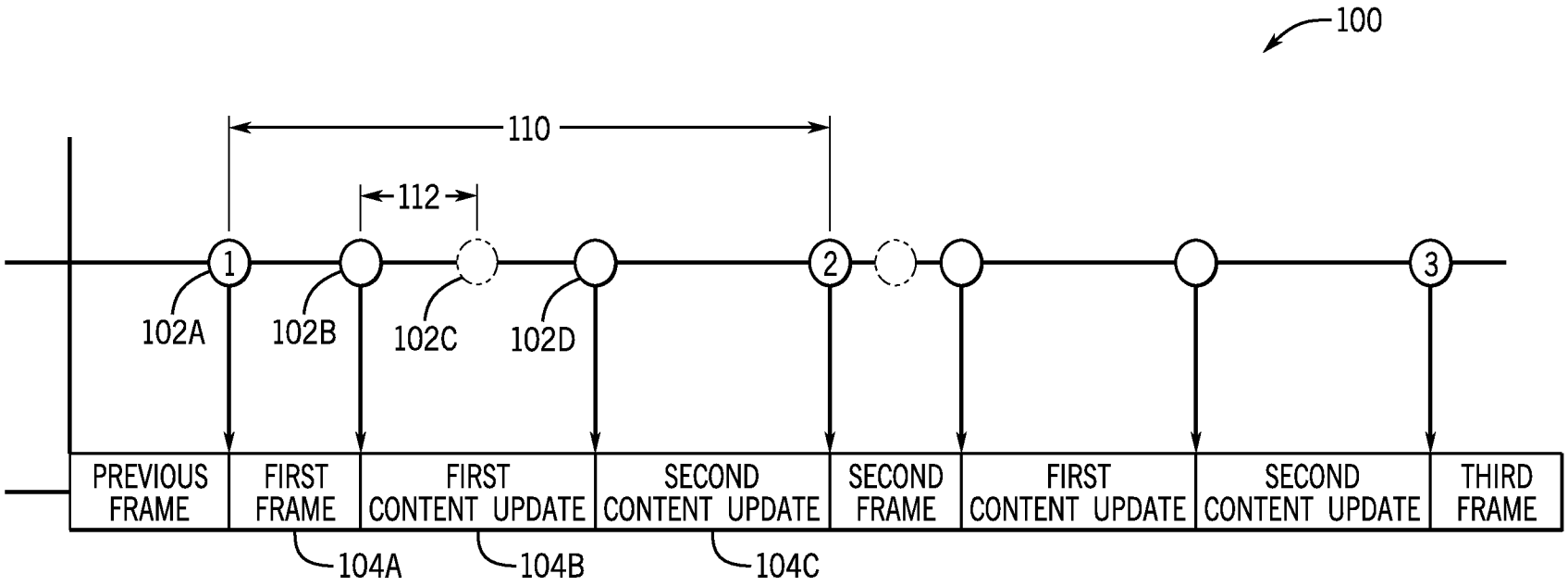
FIG. 10 is a timing diagram describing static partitioning of an image frame, in accordance with an embodiment of the present disclosure.

Particular content may be prioritized using static or dynamic partitioning. FIG. 10 depicts a timing diagram 100 describing static partitioning techniques for a variable refresh rate display, such as electronic display 18. A priority frame display period 110 may be based on a framerate associated with a priority content source. For example, the priority content source may have a framerate of 25 frames per second. As such, the priority frame display period 110 may be $1/25^{th}$ of a second. The image processing circuitry 44 may partition the priority frame display period 110 of the priority content source into any suitable number of parts or portions of at least a minimum refresh rate of the electronic display 18. Here, these partitions are shown as parts 102A, 102B, 102C, 102D. The image processing circuitry 44 may instruct the electronic display 18 to display a first priority image frame 104A based on first priority image frame data from a first (e.g., priority) content source. The image processing circuitry 44 and/or the electronic display 18 may only permit content updates at a boundary (e.g., beginning, ending) of the parts 102A, 102B, 102C, 102D. For example, a second content source may provide updated image content to image processing circuitry 44 to be displayed on the electronic display 18. The image processing circuitry 44 may generate first content update 104B based on the updated image content and may instruct the electronic display 18 to draw the first content update 104B on the electronic display 18. The image processing circuitry 44 may receive a second updated image content and may instruct the electronic display 18 to display the second content update 104C.

In certain embodiments, the image processing circuitry may partition the priority frame display period 110 based on a static partition period 112. The static partition period 112 may be an even or uneven but consistent division of the priority frame display period 110 (e.g., 2 partitions, 3 partitions, 4 partitions, 5 partitions). The static partition period 112 may be based on a minimum frame duration associated with a maximum refresh rate of the electronic display 18. For example, the static partition period 112 associated with a maximum refresh rate of 100 Hz may be $1/100^{th}$ of a second.

Figure 11:
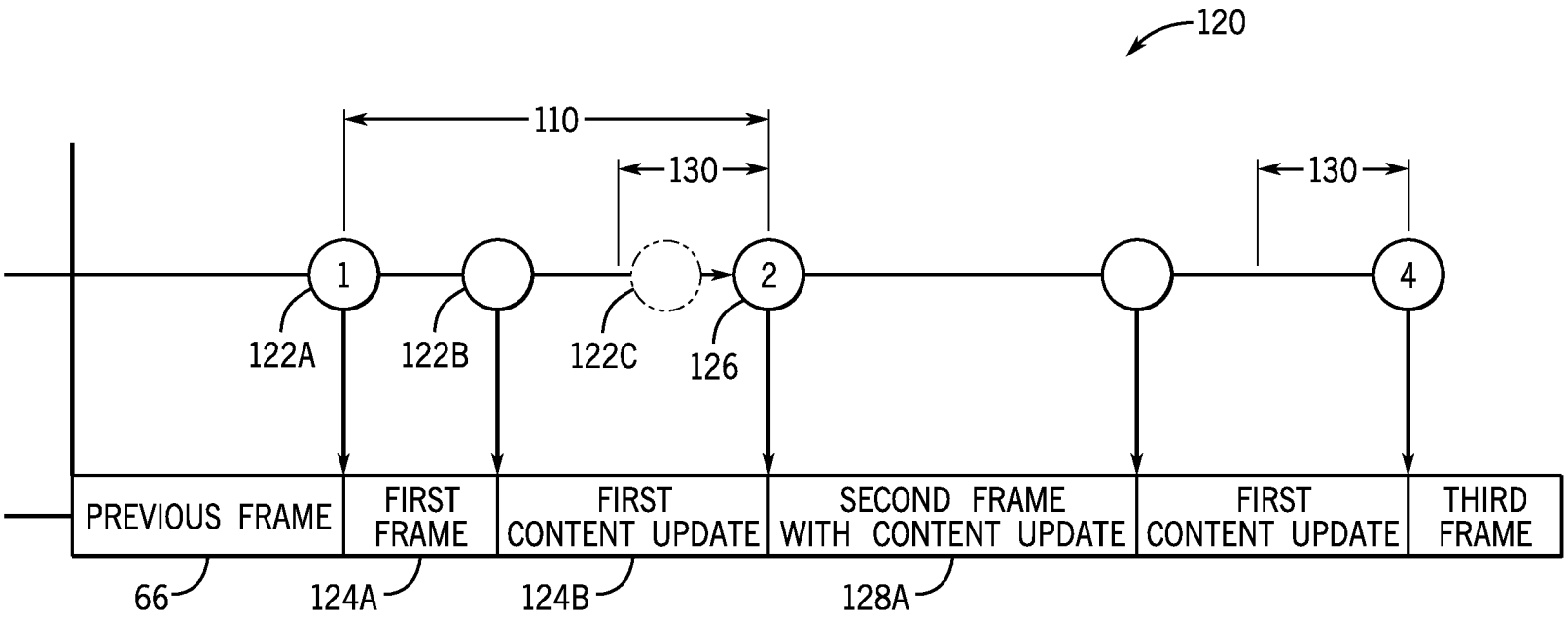
FIG. 11 is a timing diagram describing dynamic partitioning of an image frame, in accordance with an embodiment of the present disclosure.

FIG. 11 depicts a timing diagram 120 describing dynamic partitioning techniques for a variable refresh rate display, such as electronic display 18. The image processing circuitry 44 may receive first priority image frame data 122A from a priority content source and may generate a first priority image frame 124A for display on the electronic display 18. For example, the image processing circuitry 44 may instruct the electronic display 18 to draw the first priority image frame 124A on the electronic display based on the first priority image frame data 122A. The image processing circuitry 44 may determine an image frame delay period 130 as a portion of the priority frame display period 110. For example, the image frame delay period 130 may be a minimum frame duration associated with a maximum refresh rate of the electronic display 18. In some embodiments, the image frame delay period 130 may be a final portion of the priority frame display period 110. Content updates received outside of the image frame delay period 130 may trigger a new image frame to be drawn onto the electronic display 18. For example, first content update 122B may be received outside of the image frame delay period 130 and the image processing circuitry 44 may generate an image frame 124B including the first content update 122B and may instruct the electronic display 18 to draw the image frame 124B on the electronic display 18.

Any content update received from content sources within the image frame delay period 130 may be delayed until a subsequent priority image frame (e.g., second priority image frame 128A) is generated based on subsequent priority image frame data (e.g., second priority image frame data 126) received from the priority content source. For example, an image content update 122C associated with a content source may be received within the image frame delay period 130. As such, the image processing circuitry 44 may instruct the electronic display 18 to delay drawing an image frame associated with the image content update 122C until a subsequent priority image frame. Accordingly, the image processing circuitry 44 may generate the second priority image frame 128A including the image content update 122C.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ," it is intended that such elements are to be interpreted under 35 U.S.C. 112(f). However, for any claims containing elements designated in any other manner, it is intended that such elements are not to be interpreted under 35 U.S.C. 112(f).

It is well understood that the use of personally identifiable information should follow privacy policies and practices that are generally recognized as meeting or exceeding industry or governmental requirements for maintaining the privacy of users. In particular, personally identifiable information data should be managed and handled so as to minimize risks of unintentional or unauthorized access or use, and the nature of authorized use should be clearly indicated to users.

The invention claimed is:

1. An electronic device, comprising:

an electronic display configurable to:

provide a programmable latency period in response to receiving a first image frame corresponding to first image frame data;

display the first image frame after the programmable latency period;

during display of the first image frame, receive a second image frame corresponding to second image frame data; and repeat display of the first image frame in response to receiving the second image frame.

2. The electronic device of claim 1, comprising image processing circuitry configurable to send the second image frame to the electronic display during display of the first image frame.

3. The electronic device of claim 1, wherein the electronic display is configurable to repeat display of the first image frame for a duration corresponding to the programmable latency period.

4. The electronic device of claim 1, wherein the programmable latency period is based on a maximum refresh rate of the display.

5. The electronic device of claim 1, wherein the electronic display is configurable to:

receive a third image frame corresponding to third image frame data; and display the third image frame after the programmable latency period.

6. The electronic device of claim 1, wherein the programmable latency period is equal to or greater than a minimum frame duration associated with a refresh rate of the electronic display.

7. The electronic device of claim 1, wherein the electronic display is configurable to:

receive a third image frame corresponding to third image frame data; and adjust the programmable latency period based on the third image frame data.

8. The electronic device of claim 1, wherein the electronic display is configurable to remove the programmable latency period.

9. The electronic device of claim 1, wherein the programmable latency period is less than a minimum frame duration associated with the electronic display.

10. One or more tangible, non-transitory, computer-readable media, comprising computer-readable instructions that, when executed by one or more processors of an electronic device, cause the one or more processors to:

receive first image frame data associated corresponding to a first image frame, wherein the first image frame data is associated with a first framerate from a first content source;

during display of the first image frame, receive a content update associated with a second framerate from a second content source; and after a frame delay period based on the first framerate, instruct an electronic display to display the content update.

11. The one or more tangible, non-transitory, computer-readable media of claim 10, wherein the computer-readable instructions cause the one or more processors to partition a display period for the first image frame into a first portion and a second portion.

12. The one or more tangible, non-transitory, computer-readable media of claim 11, wherein the computer-readable instructions cause the one or more processors to instruct the electronic display to display the content update at a boundary of the first portion.

13. The one or more tangible, non-transitory, computer-readable media of claim 12, wherein the computer-readable instructions cause the one or more processors to:

during display of the first image frame, receive a second content update from the second content source; and instruct the electronic display to display the second content update at a boundary of the second portion.

14. The one or more tangible, non-transitory, computer-readable media of claim 13, wherein the boundary of the second portion of the display period is a beginning of the second portion of the display period.

15. The one or more tangible, non-transitory, computer-readable media of claim 13, wherein the first portion and the second portion are equal.

16. The one or more tangible, non-transitory, computer-readable media of claim 10, wherein the first framerate is less than the second framerate.

17. An electronic device, comprising:

an electronic display configured to:

display a first image frame associated with a first framerate from a first content source;

during a frame delay period of the first image frame, receive a content update from a second content source;

receive second image frame data associated with the first content source; and after the frame delay period, display a second image frame based on the second image frame data and the content update.

18. The electronic device of claim 17, wherein the frame delay period corresponds to a minimum frame duration.

19. The electronic device of claim 17, wherein the frame delay period is based on a maximum refresh rate of the electronic display.

20. The electronic device of claim 17, wherein the electronic display is configured to:

receive a second content update outside of the frame delay period; and display a third image frame based on the second content update.

* * * * *